US008951087B2

(12) United States Patent
Doroszkiewicz

(10) Patent No.: US 8,951,087 B2
(45) Date of Patent: Feb. 10, 2015

(54) WIRE TOY MANDALA

(76) Inventor: Zbigniew Doroszkiewicz, San Francisco, CA (US)

( * ) Notice: Subject to any disclaimer, the term of this patent is extended or adjusted under 35 U.S.C. 154(b) by 0 days.

(21) Appl. No.: 13/465,009

(22) Filed: May 6, 2012

(65) Prior Publication Data

US 2012/0315818 A1 Dec. 13, 2012

Related U.S. Application Data

(60) Provisional application No. 61/494,257, filed on Jun. 7, 2011.

(51) Int. Cl.

| | |
|---|---|
| ***A63H 33/00*** | (2006.01) |
| ***A47G 21/16*** | (2006.01) |
| ***A47G 33/08*** | (2006.01) |
| *A63F 9/08* | (2006.01) |
| *A44C 5/00* | (2006.01) |
| *A44C 11/00* | (2006.01) |

(52) U.S. Cl.

CPC ..... *A47G 21/16* (2013.01); *A47G 33/08* (2013.01); *A63F 9/0876* (2013.01); *A44C 5/0076* (2013.01); *A44C 11/002* (2013.01)

USPC ..... 446/71

(58) Field of Classification Search

USPC ..... 446/71

See application file for complete search history.

(56) References Cited

U.S. PATENT DOCUMENTS

| | | | | |
|---|---|---|---|---|
| 4,603,853 | A * | 8/1986 | Satterthwaite | 482/35 |
| 5,112,268 | A * | 5/1992 | Klaus | 446/489 |
| 5,114,377 | A * | 5/1992 | Cove Mercuri et al. | 446/487 |
| D334,952 | S * | 4/1993 | Davis et al. | D21/482 |
| 5,725,214 | A * | 3/1998 | Adams | 273/158 |
| 6,676,481 | B2 * | 1/2004 | Klaus et al. | 446/489 |
| 8,458,918 | B2 * | 6/2013 | Ostberg | 33/562 |
| 2005/0090178 | A1 * | 4/2005 | Snyder | 446/71 |

* cited by examiner

*Primary Examiner* — Michael Dennis
*Assistant Examiner* — Dolores Collins

(57) ABSTRACT

Example implementations relate to one product with multiple functions. For example, implementations may include two halves, each including four sets of seven half rings connected to a large ring. The two halves may then be connected together using banding wire. In this manner, implementations may be changed into many different forms and shapes and are suitable for meditation, relaxation, and as a toy. For example, implementations can be formed into jewelry, a holder for a pen, napkin, candle, or orange, and many other shapes. Example implementations can be used outside or inside as a decoration on a table, on a wall, or as an ornament. Geometrical and changeable forms can help children to develop their imagination. Stainless steel surgical wire that may be used in this toy is very safe and a non-allergic material so that people of all ages can use the toy.

6 Claims, 15 Drawing Sheets

WIRE TOY MANDALA

I claim priority to Provisional Application Ser. No. 61/494,257, filed on Jun. 7, 2011 and entitled "WIRE TOY MANDALA—Multifunctional jewelry, holder, meditation tool, and Christmas ornament."

BACKGROUND OF THE INVENTION

The original design of the Wire Toy Mandala with four sets of nine half circle rings, all the same size, came to me by way of my Great-Grandfather in Central Europe. He created a 'Wire Toy', approximately between the years 1903-1905. It was passed through my family by way of my Grandfather and Father. I have created a unique version of this design with a series of multiple layers of sets of half circular rings. The Mandala itself is an ancient Tibetan motif that is used in meditation and Art designs for 2-dimensional painting. I have created a three dimensional wire version of the traditional mandala design with eight sets of seven half wire rings in four different sizes, creating a design that has many functions and uses.

BRIEF DESCRIPTION OF THE DRAWINGS

The following detailed description references the drawings, wherein.

DETAILED DESCRIPTION

The present disclosure describes a multifunctional wire toy, jewelry, holder, meditation or relaxation tool, and X-mas ornament.

Figure 1:
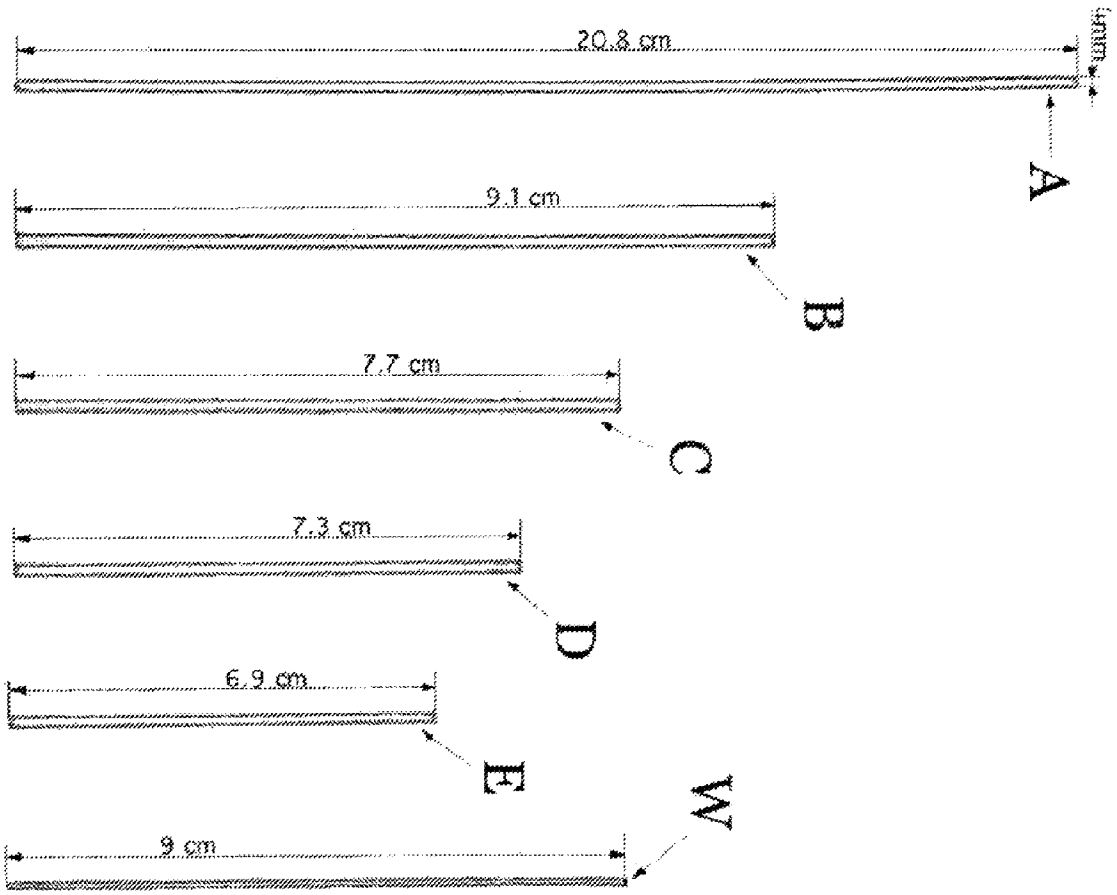
FIG. 1 illustrates straight wire (A) used to form circular rings, straight wires (B, C, D, and E) used to form half rings, and wire (W) used to connect half rings together.

The device is comprised of the following wires and beads:

A—2 Straight wires for big wire rings $A_1$, as shown in FIG. 1.

B—14 Straight wires for big wire half rings $B_1$, as shown in FIG. 1.

C—14 Straight wires for medium wire half rings $C_1$, as shown in FIG. 1.

D—14 Straight wires for small wire half rings $D_1$, as shown in FIG. 1.

E—14 Straight wires for mini wire half rings $E_1$, as shown in FIG. 1.

W—Straight wire for banding connection wire $W_1$, as shown in FIG. 1.

Figure 3:
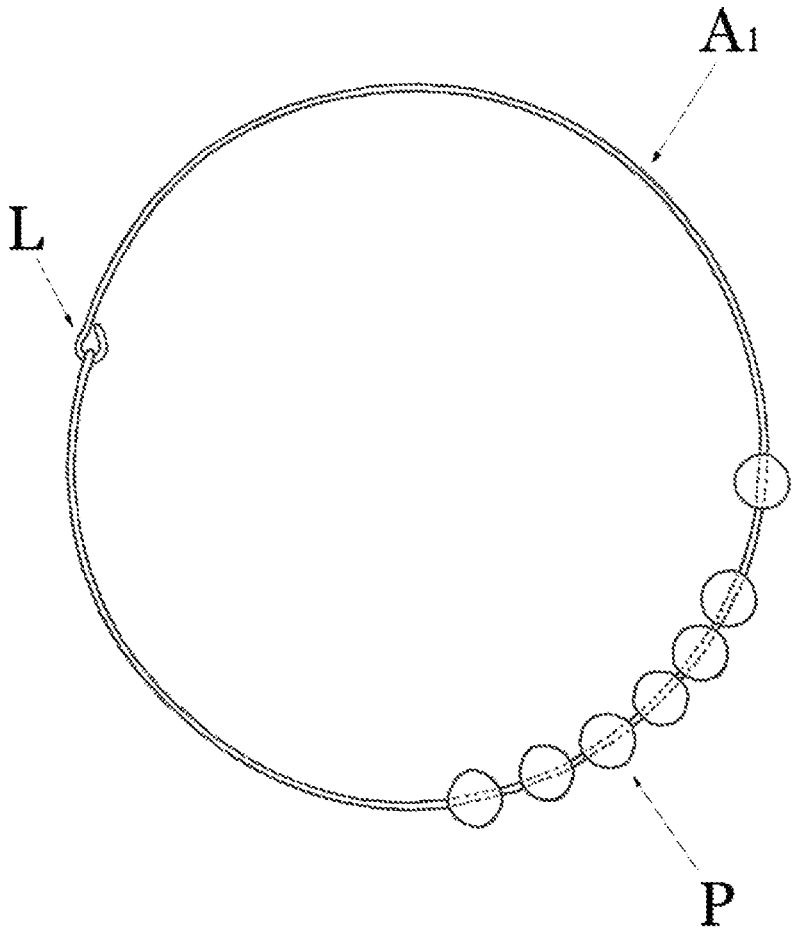
FIG. 3 illustrates circular ring ($A_1$) with seven beads (P).

P—14 beads to place on big wire rings (7 on each ring), as shown in FIG. 3.

Straight wire is cut to appropriate lengths for corresponding sizes (wires A, B, C, D, E, W), as shown in FIG. 1.

Figure 2A:
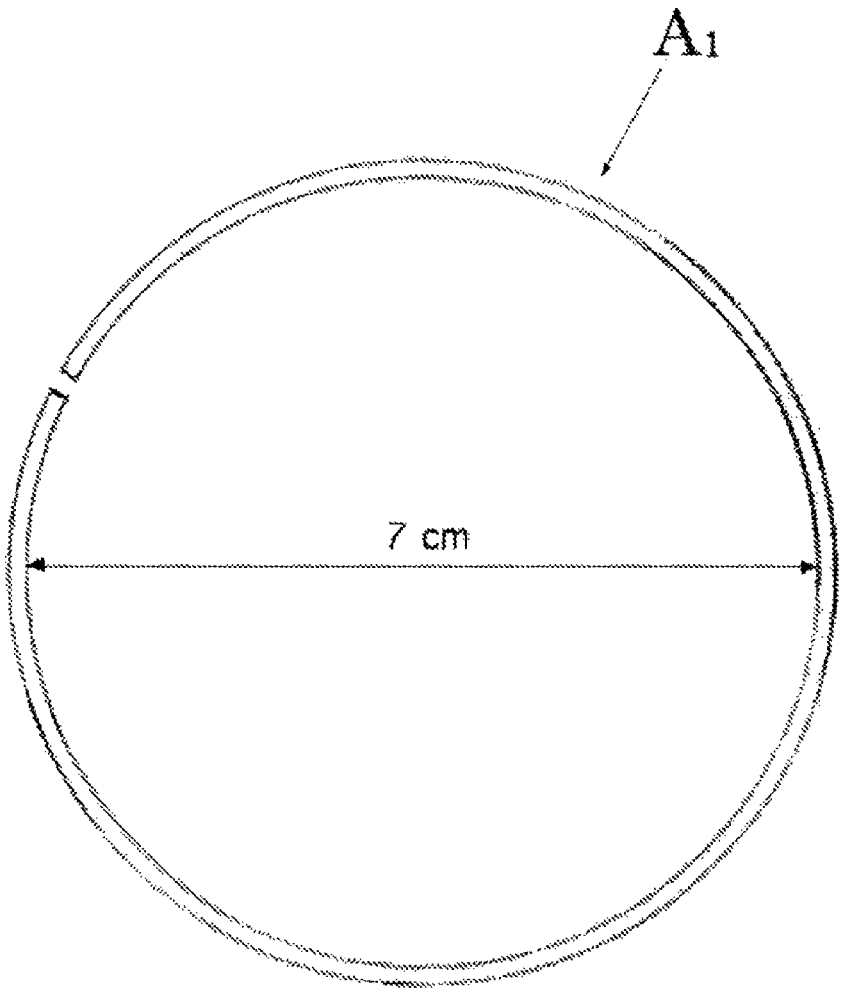
FIG. 2*a* illustrates straight wire (A) of FIG. 1 formed into a circular ring ($A_1$).
Figure 2B:
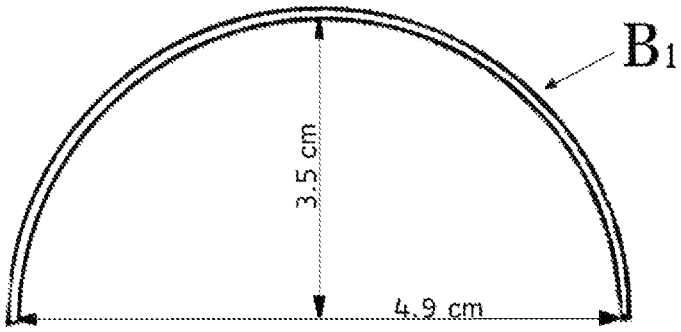
FIG. 2*b* illustrates straight wire (B) of FIG. 1 formed into a big half ring ($B_1$).
Figure 2C:
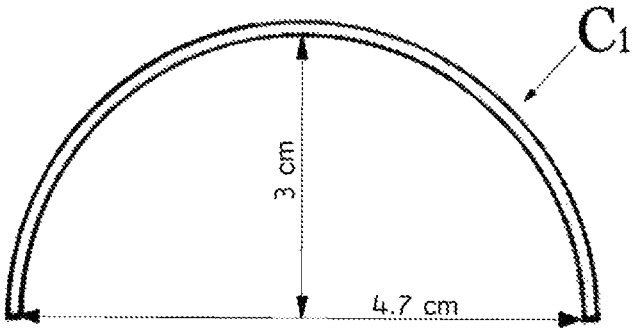
FIG. 2*c* illustrates straight wire (C) of FIG. 1 formed into a medium half ring ($C_1$).
Figure 2D:
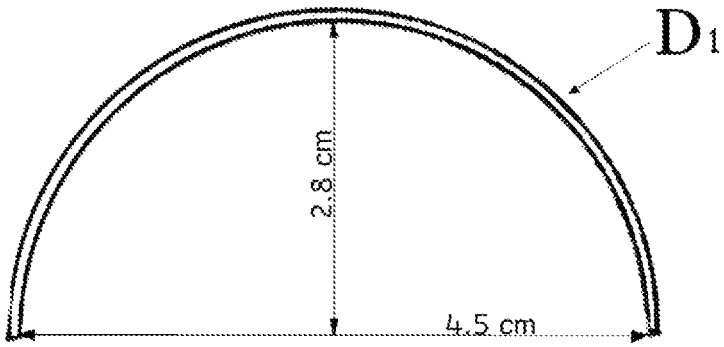
FIG. 2*d* illustrates straight wire (D) of FIG. 1 formed into a small half ring ($D_1$).
Figure 2E:
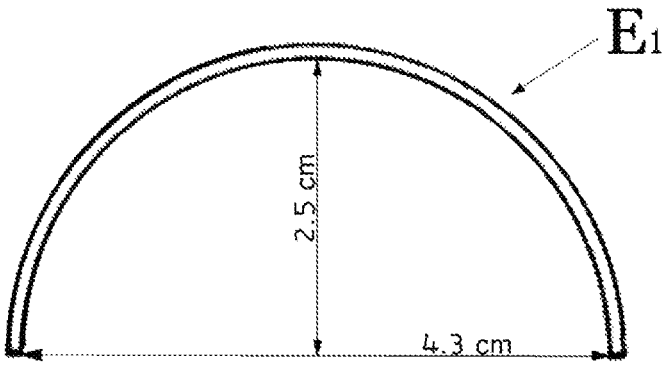
FIG. 2*e* illustrates straight wire (E) of FIG. 1 formed into a mini half ring ($E_1$).
Figure 2F:
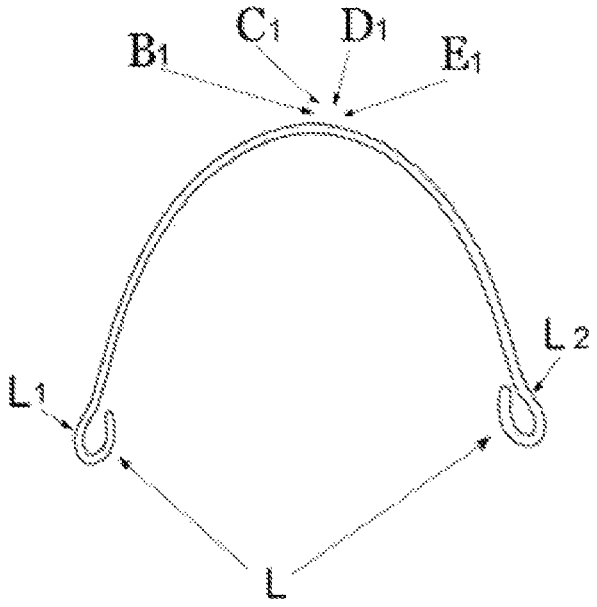
FIG. 2*f* illustrates a half ring with loops on each end.

Two straight wires (A) are formed into circles as shown in FIGS. 2*a* and 3. 14 wires (B) are formed into the big half rings ($B_1$) as shown in FIGS. 2*b* and 2*f*. 14 wires (C) are formed into the medium half rings ($C_1$) as shown in FIGS. 2*c* and 2*f*. 14 wires (D) are formed into the small half rings ($D_1$) as shown in FIGS. 2*d* and 2*f*. 14 wires (E) are formed into the mini half rings ($E_1$) as shown in FIGS. 2*e* and 2*f*.

All wires ($A_1$, $B_1$, $C_1$, $D_1$, $E_1$) get loops (L, $L_1$, $L_2$) (FIG. 2*f*) at the end of each wire to create a connection in between each other. The connection between all wires is done by squeezing loops into a perfect small ring which allows them to move around in a very flexible matter.

By connecting all formed wires in the proper way, it creates a changeable wire toy.

Long wire (A) creates a big ring ($A_1$) with 7 beads (P) placed all around. The ends of the big ring are connected by small loops as shown in FIG. 3. The loops are squeezed together to create a stable connection for a full circle shaped ring. Four sets of seven half rings are connected to the big ring, one after the other by squeezing all loops ($L_1$, $L_2$), as shown in FIG. 2*f*.

Figure 4:
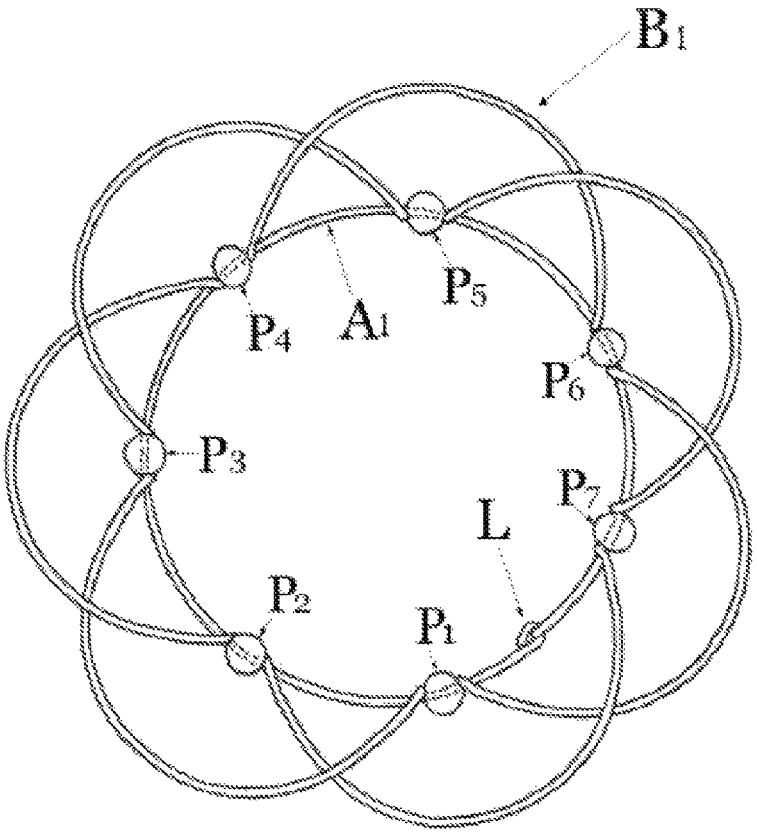
FIG. 4 illustrates circular ring ($A_1$) with seven beads (P), and seven big half rings ($B_1$).

As shown in FIG. 4, 7 big half rings ($B_1$) are connected all around the big ring ($A_1$) to create a first movable set. First big half ring ($B_1$) is placed by the loop ($L_1$) on the big ring after the first bead ($P_1$) and after the second bead ($P_2$) by placing loop ($L_2$). Second big half ring ($B_1$) is placed after the third bead ($P_3$) by loop ($L_1$) and after the fourth bead ($P_4$) by loop ($L_2$). The third big half ring ($B_1$) is placed after the fifth bead ($P_5$) by loop ($L_1$) and after the sixth bead ($P_6$) by loop ($L_2$). The fourth big half ring ($B_1$) is placed after the seventh bead ($P_7$) by loop ($L_1$), under first big half ring ($B_1$) and before second bead ($P_2$) by loop ($L_2$). The fifth big half ring ($B_1$) is placed after the second bead ($P_2$) by loop ($L_1$), under the second big half ring ($B_1$), over the third big half ring ($B_1$) and before the fourth bead ($P_4$) by loop ($L_2$). The sixth big half ring ($B_1$) is placed after the fourth bead ($P_4$) by loop ($L_1$), under the third big half ring ($B_1$), over the fourth big half ring ($B_1$) and before the sixth bead ($P_6$) by loop ($L_2$). The seventh big half ring ($B_1$) is placed after the sixth bead ($P_6$) by loop ($L_1$) under the fourth big half ring ($B_1$), over the fifth half ring and before first bead ($P_1$) by loop ($L_2$). The wire loops are depicted in FIG. 2*f*.

All elements connected correctly and in the proper way are necessary for this toy to be able to change forms and be fully functional. The functions are limited only to the individual's imagination.

Figure 5:
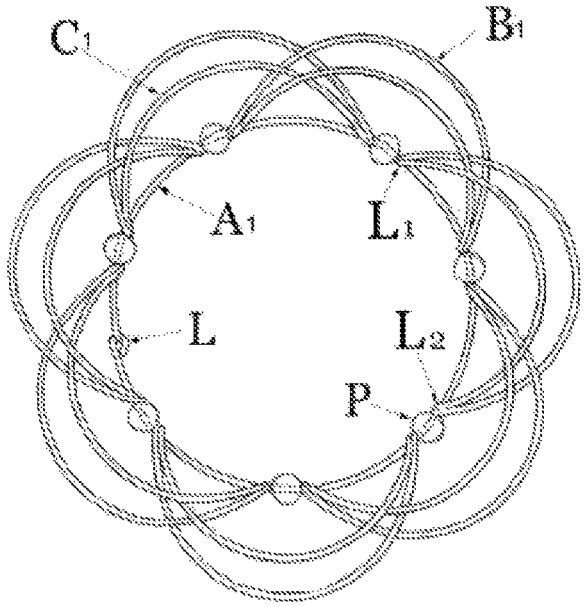
FIG. 5 illustrates circular ring ($A_1$) with seven beads (P), seven big half rings ($B_1$), and seven medium half rings ($C_1$).
Figure 6:
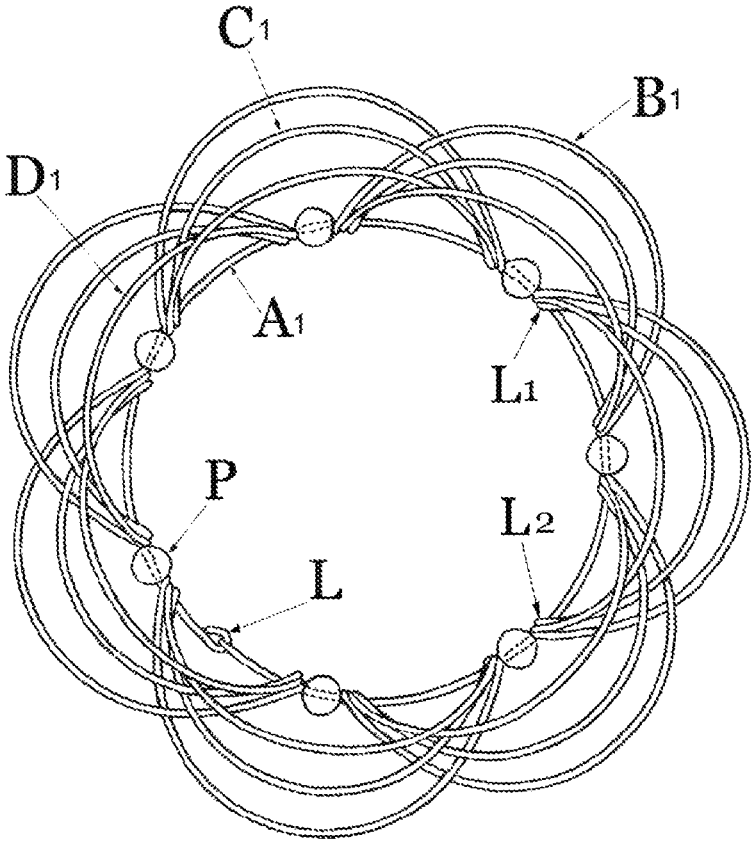
FIG. 6 illustrates circular ring ($A_1$) with seven beads (P), seven big half rings ($B_1$), seven medium half rings ($C_1$), and seven small half rings ($D_1$).
Figure 7:
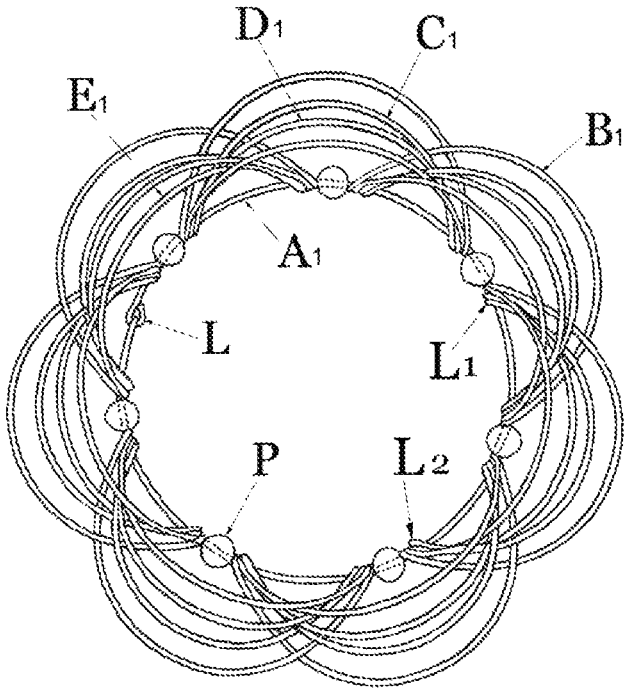
FIG. 7 illustrates circular ring ($A_1$) with seven beads (P), seven big half rings ($B_1$), seven medium half rings ($C_1$), seven small half rings ($D_1$), and seven mini half rings ($E_1$).

7 big half rings ($B_1$) are connected all around to the big ring ($A_1$) to create first movable set, as shown in FIG. 4 and described above. Then 7 medium half rings ($C_1$) are connected all around again to big ring ($A_1$) on top of rings ($B_1$) to create a movable second set on top of the first set, as shown in FIG. 5. Then 7 small half rings ($D_1$) are connected all around again to the big ring ($A_1$) on top of rings ($C_1$) to create a third movable set on top of the second set, as shown in FIG. 6. Then 7 mini half rings ($E_1$) are connected all around again to big ring ($A_1$) on top of rings ($D_1$) to create a fourth movable set on top of the third set, as shown in FIG. 7.

As depicted in the figures and described above, all four sets of 7 half rings are placed on big ring ($A_1$). The connection loops of each half ring of the four sets of 7 half rings are separated by one bead. The bead is a decorative element in the toy, but also allows the loop connections to work smoothly around each other.

The sets of 7 half rings are attached sequentially in a proper way, so that they are able to rotate forward & backward on the main ring wire ($A_1$). By pushing one set of half rings from the set of 7, all other half rings in the set are automatically pushed to open and close together.

It is possible to use one set of 7 rings for changing forms individually. It is also possible to use all 3 sets of 7 rings to change forms together at the same time. Each half ring wire is attached with the looped ends to the main large circle wire ($A_1$) in an order that each subsequent wire out of the set of 7 is placed. When the first established half ring is centered onto the main wire ($A_1$), the subsequent six half rings with looped ends are placed in front of the first and prior half rings, subsequently one after the other until the set of 7 is created. In this manner, the rings are connected to each other and allowed to move together at the same time.

Figure 8:
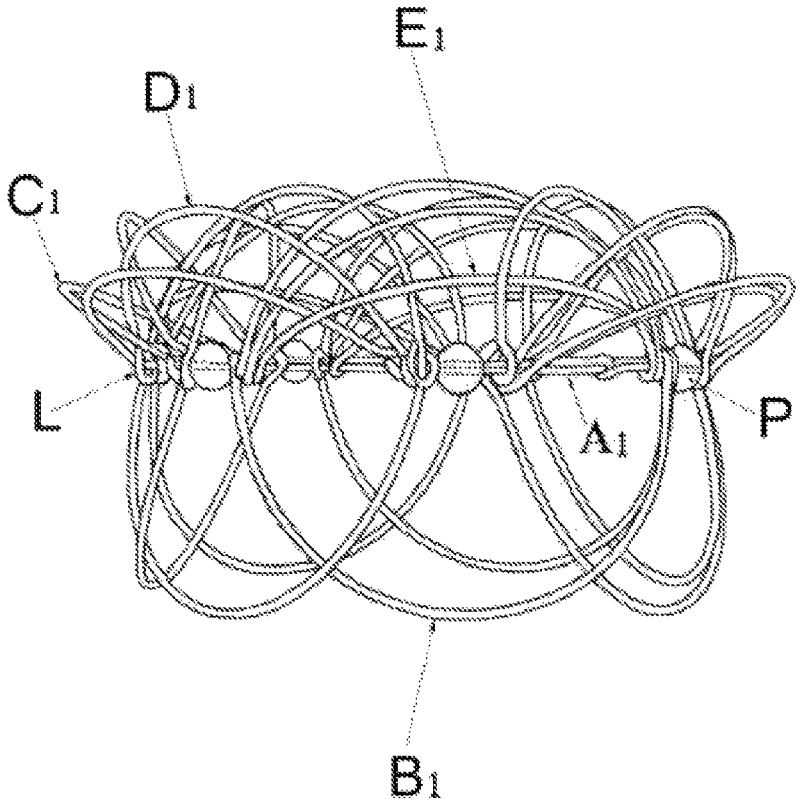
FIG. 8 illustrates a side view of a half open toy.

By placing four sets of half rings over the large circle wire ($A_1$) with 7 beads, this completes and creates the first half of the toy, as shown in FIG. 8.

Figure 9:
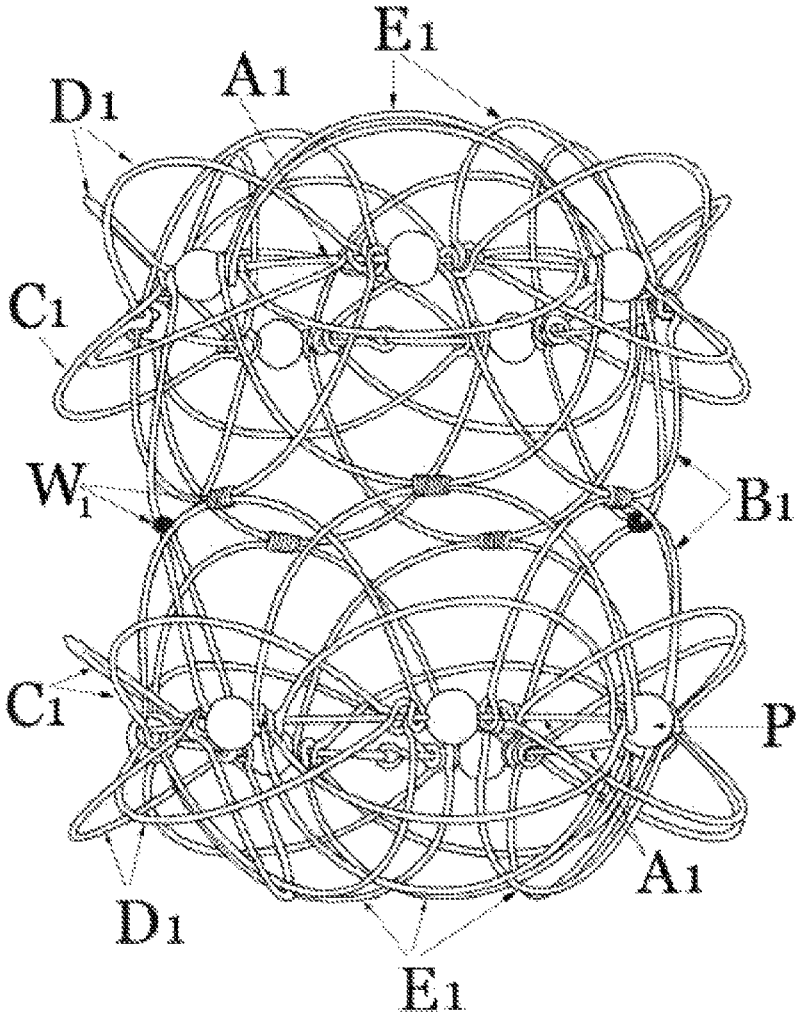
FIG. 9 illustrates a side view of 2 half open parts of the toy connected together into one fully completed toy.
Figure 10:
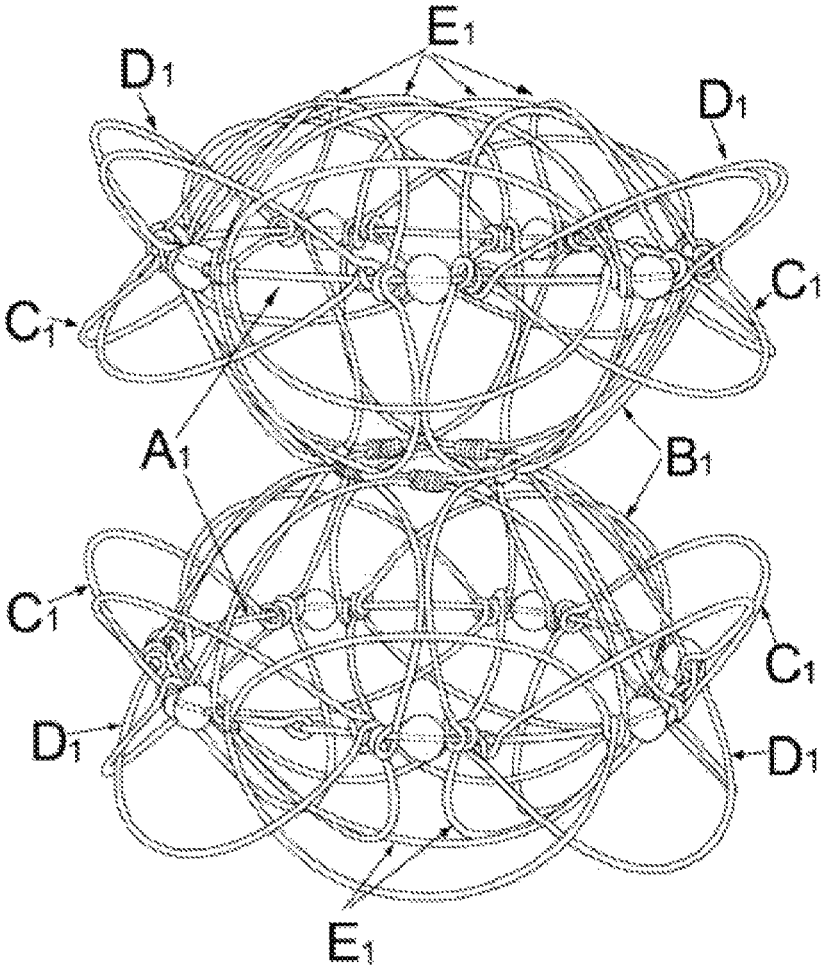
FIG. 10 illustrates a side view of a fully completed toy squeezed in the middle.
Figure 11:
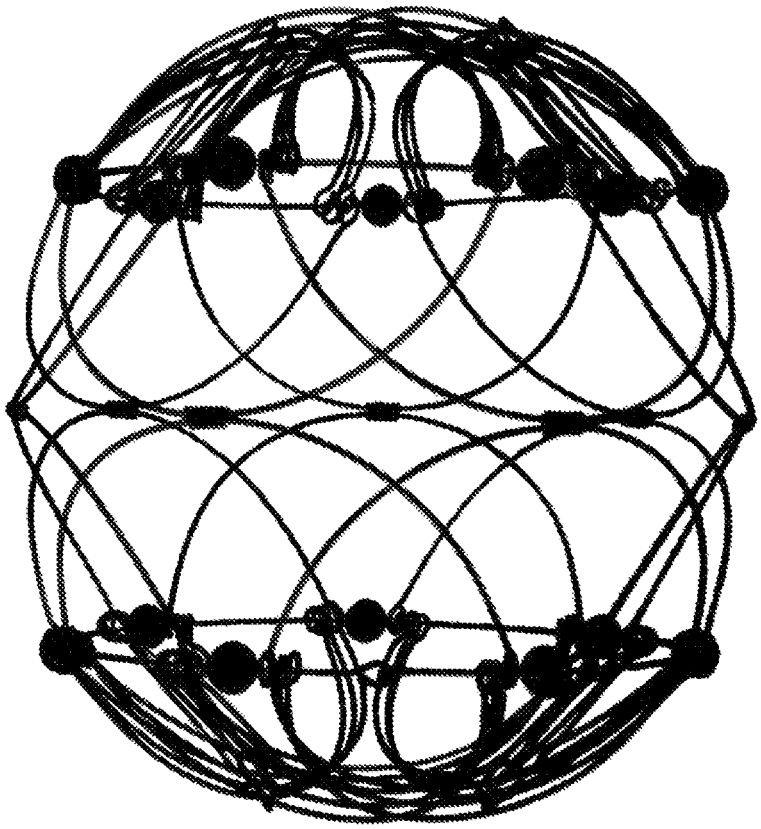
FIG. 11 illustrates a side view of a complete toy formed into a ball.

The same procedure is used again a second time to create the identical second half of the toy, as shown in FIG. 9.

Figure 2G:
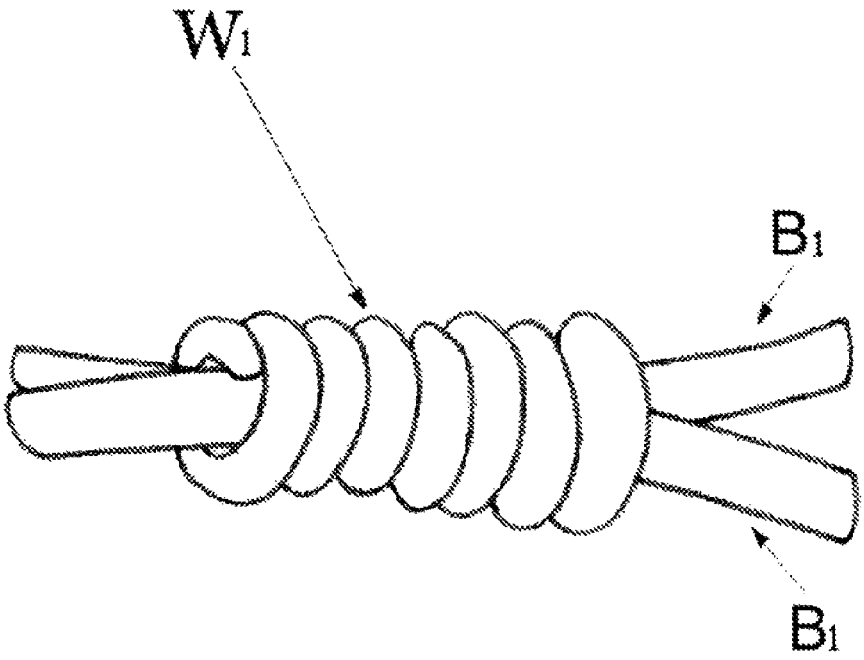
FIG. 2*g* illustrates a thin banding wire ($W_1$) used to connect half rings.

Two big rings ($A_1$) with 28 half rings in 4 sets around (FIG. 8) are connected to each other by connecting all big half rings ($B_1$) using thin banding wire ($W_1$), depicted in FIG. 2*g*. This final connection between the big half rings ($B_1$) creates a complete multi-functional changeable toy.

You can change it into different forms by moving half rings in and out of the big rings ($A_1$). You can make the structure flat, into a ball, and all forms in-between.

By changing forms you can create many different shapes and functions, including bracelets, earrings, hair buns or ponytail holders, hair ornaments, necklaces, apple or ball holders, pen holders, napkin rings, soda can or glass holders, candle stands, and more.

You can use it for fun, playing as a toy, or using it as a decoration, X-mas ornament, or jewelry or meditation tool.

What is claimed:

1. A wire toy mandala comprising:

a first half and a second half, wherein each half comprises:

a full wire ring of a first length bent into a circle;

a first set of seven semi-circular wire half rings each of a second length less than the first length, wherein the seven half rings in the first set are rotatably attached to the full wire ring around the entire circumference of the full wire ring in a sequential manner such that a first side of each half ring in the first set is in front of a prior half ring in the first set and a second side of each half ring in the first set is behind a subsequent half ring in the first set to enable concurrent movement of all half rings in the first set;

a second set of seven semi-circular wire half rings each of a third length less than the second length, wherein the seven half rings in the second set are rotatably attached to the full wire ring around the entire circumference of the full wire ring in a sequential manner such that a first side of each half ring in the second set is in front of a prior half ring in the second set and a second side of each half ring in the second set is behind a subsequent half ring in the second set to enable concurrent movement of all half rings in the second set;

a third set of seven semi-circular wire half rings each of a fourth length less than the third length, wherein the seven half rings in the third set are rotatably attached to the full wire ring around the entire circumference of the full wire ring in a sequential manner such that a first side of each half ring in the third set is in front of a prior half ring in the third set and a second side of each half ring in the third set is behind a subsequent half ring in the third set to enable concurrent movement of all half rings in the third set; and a fourth set of seven semi-circular wire half rings each of a fifth length less than the fourth length, wherein the seven half rings in the fourth set are rotatably attached to the full wire ring around the entire circumference of the full wire ring in a sequential manner such that a first side of each half ring in the fourth set is in front of a prior half ring in the fourth set and a second side of each half ring in the fourth set is behind a subsequent half ring in the fourth set to enable concurrent movement of all half rings in the fourth set; and a coupling between the first half of the wire toy mandala and the second half of the wire toy mandala, wherein each half ring in the first set of the first half is rotatably coupled to an adjacent half ring in the first set of the second half.

2. The wire toy mandala of claim 1, wherein each half ring in the first, second, third, and fourth sets of the first half and the second half is coupled to the full wire ring via a loop formed on each end of the half ring.

3. The wire toy mandala of claim 1, wherein each half of the wire toy mandala further comprises:

a set of seven beads placed onto the full wire ring between connections of the wire half rings to the full wire ring.

4. The wire toy mandala of claim 1, wherein the coupling between the first half and the second half comprises a banding wire wrapped around each connection between a respective half ring in the first set of the first half and a corresponding half ring in the first set of the second half.

5. The wire toy mandala of claim 1, wherein the full wire ring in the first half and the second half is 4 mm in thickness.

6. The wire toy mandala of claim 1, wherein:

the full wire ring of the first half and the second half is 20.8 cm in length;

each half ring in the first set of the first half and the second half is 9.1 cm in length;

each half ring in the second set of the first half and the second half is 7.7 cm in length;

each half ring in the third set of the first half and the second half is 7.3 cm in length; and each half ring in the fourth set of the first half and the second half is 6.9 cm in length.

* * * * *